United States Patent [19]

Tombs et al.

[11] 4,107,510

[45] Aug. 15, 1978

[54] STARTING AIDS FOR COMBUSTION ENGINES

[75] Inventors: Terence Leslie Tombs; Brian Leslie Miles; Dexter William Smith, all of Birmingham, England

[73] Assignee: C.A.V. Limited, Birmingham, England

[21] Appl. No.: 582,189

[22] Filed: May 30, 1975

Related U.S. Application Data

[63] Continuation of Ser. No. 422,149, Dec. 6, 1973, abandoned.

[30] Foreign Application Priority Data

| | | | |
|---|---|---|---|
| Dec. 7, 1972 | [GB] | United Kingdom | 56505/72 |
| Mar. 3, 1973 | [GB] | United Kingdom | 10454/73 |
| Mar. 15, 1973 | [GB] | United Kingdom | 12546/73 |
| Jul. 6, 1973 | [GB] | United Kingdom | 32448/73 |
| Jul. 28, 1973 | [GB] | United Kingdom | 36052/73 |

[51] Int. Cl.[2] ..... F02P 19/02; F23Q 7/22; H05B 3/02

[52] U.S. Cl. ..... 219/270; 123/145 A; 219/523; 219/541; 219/553; 252/512; 338/329; 338/330; 361/264

[58] Field of Search ..... 219/260, 270, 523, 541, 219/553, 207, 220, 267, 232, 233; 338/330, 327, 316, 329; 252/512, 513; 317/98; 123/145 R, 145 A; 361/264–266; 431/258, 259

[56] References Cited

U.S. PATENT DOCUMENTS

| | | | |
|---|---|---|---|
| 1,373,583 | 4/1921 | Adams | 317/98 X |
| 1,404,063 | 1/1922 | Roddis | 219/553 |
| 1,627,564 | 5/1927 | Loper | 219/553 X |
| 1,948,974 | 2/1934 | Talmey | 123/145 A |
| 2,178,659 | 11/1939 | White | 123/145 A |
| 2,198,850 | 4/1940 | White | 123/145 A |
| 2,492,755 | 12/1949 | McCollum | 219/270 X |
| 2,858,403 | 10/1958 | Butler | 219/523 UX |
| 3,309,643 | 3/1967 | Ferretti et al. | 338/330 |
| 3,319,130 | 5/1967 | Betteridge | 123/145 A |
| 3,360,761 | 12/1967 | Stapleton et al. | 338/330 |

FOREIGN PATENT DOCUMENTS

| | | | |
|---|---|---|---|
| 489,225 | 9/1918 | France | 123/145 A |
| 1,056,874 | 5/1959 | Fed. Rep. of Germany | 123/145 A |

*Primary Examiner*—A. Bartis
*Attorney, Agent, or Firm*—Holman & Stern

[57] ABSTRACT

An ignition aid for internal combustion engines includes a sintered refractory ceramic composite heating element having a high resistance central portion interposed between a low resistance terminal end portions. The heating element is positioned in a hollow electrically conductive body adapted to be removably inserted in an aperture in an engine. The heating element is disposed between and has its terminal end portions in electrical non-point contact with a bridge portion at one end of the hollow body and an electrode rod extending into the hollow body in sealed relation therewith. In one embodiment, the electrode rod comprises a pair of relatively movable parts, one of which is resiliently biased into engagement with the heating element by a resilient PTC resistance element electrically connecting the parts. In another embodiment, the heating element terminal portions are diffusion bonded to the electrode rod and bridge portion, respectively.

7 Claims, 3 Drawing Figures

STARTING AIDS FOR COMBUSTION ENGINES

Figure 1:
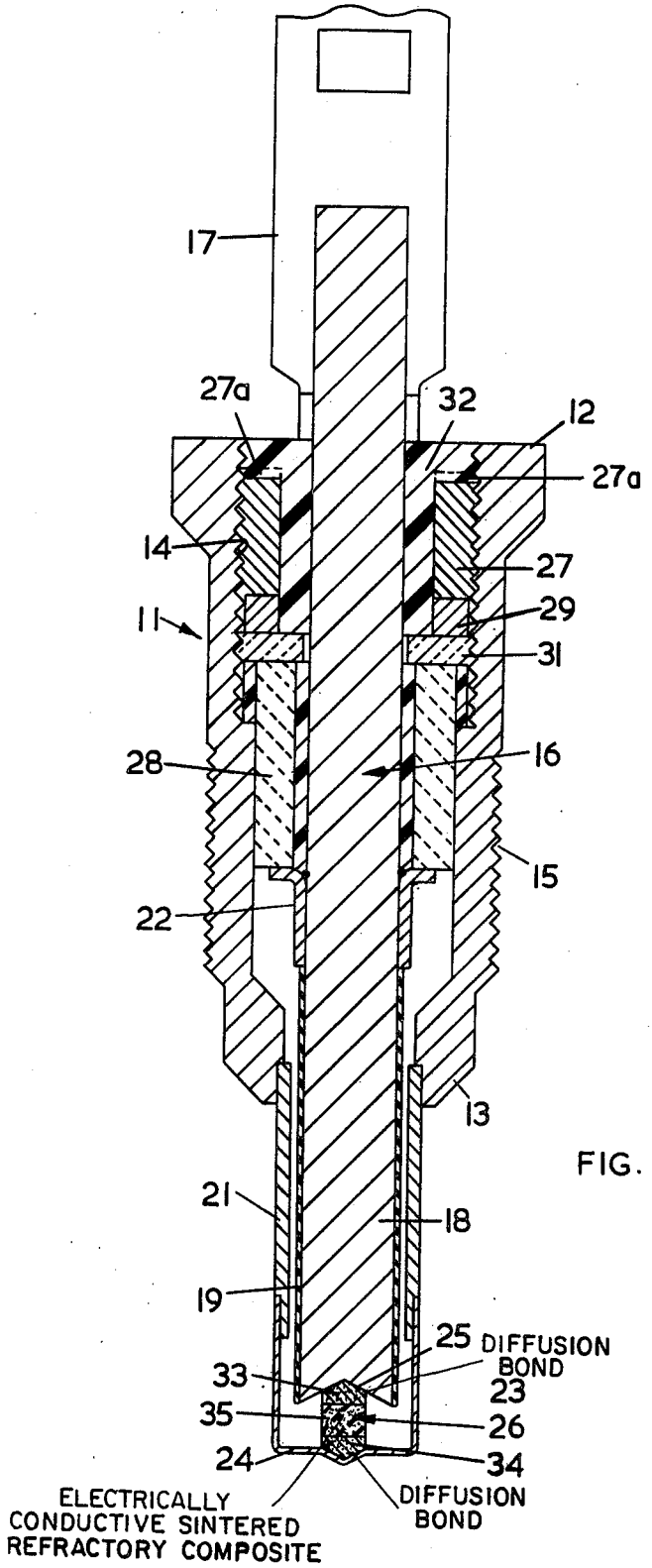

This is a continuation of application Ser. No. 422,149 filed Dec. 6, 1973 now abandoned.

This invention relates to starting aids for combustion engines.

In its broadest aspect, the invention resides in a starting aid including a body, an electrical heating element carried by the body, and an electrode carried by the body and electrically connected to the heating element so that current can be supplied to the heating element to raise its temperature, the heating element including a sintered, electrically conducting, refractory block.

Conveniently, the heating element is annular and the electrode is received in the bore in the heating element so as to be electrically connected to the internal peripherythereof, the other electrical connection to the heating element being made to its external periphery.

More preferably, the electrode is electrically connected to one end of the heating element, the other electrical connection to the heating element being made to an opposite end thereof.

In a further aspect, the invention resides in a starting aid including a body, an electrical heating element carried by the body, and an electrode carried by the body and electrically connected to the heating element so that current can be supplied to the heating element to raise its temperature, the heating element including a sintered, electrically conducting, refractory block and the refractory block being under compression.

Preferably, the electrode is urged against the refractory block so as to place the block under compression.

Conveniently, the electrode is urged against the block by a screw-threaded member which is engaged with a screw-threaded portion of the body in such a way as to apply a predetermined force to the electrode.

Alternatively, the electrode is urged against the block by resilient means.

Preferably, co-operating location means are provided on block and the electrode respectively to retain the block in the required position relative to the electrode.

Preferably, the refractory block is urged by the electrode into physical and electrical contact with a conductive member so that, in use to raise the temperature of the heating element, current is passed between the electrode and the conductive member through the heating element.

Preferably, co-operating location means are provided on the block and the conductive member respectively to retain the block in the required position relative to the conductive member.

Preferably, the body is also conductive and the conductive member is supported by the body in electrical connection therewith, the electrode being insulated from the body.

Preferably, the body is hollow and the electrode extends through the body but is spaced therefrom, at least part of the space between the electrode and the body being filled by a sealing material which, in use, prevents passage of combustion gases through the body.

Conveniently, the sealing material is an epoxy resin or fused glass.

Preferably, the heating element is electrically connected to a resistance element, which exhibits a substantial increase in resistance with rising temperature, so that when the aid is connected to a source of electric supply the initial flow of current through the heating element will be high so as to achieve rapid heating of the heating element, and as the resistance element heats up due to the flow of current therethrough the increasing resistance of the resistance element will act to reduce the current flow through the heating element thereby preventing overheating of the heating element.

Preferably, the refractory block is formed at least in part of a sintered mixture of a metal and a ceramic.

Preferably, the ceramic is a metal oxide.

Preferably, the metal is chromium and the metaloxide is alumina or chromic oxide.

Preferably, the refractory block is a composite, with said sintered mixture defining a central portion of the composite and being interposed between a pair of outer portions each containing a metal.

Preferably, the central portion and the pair of outer portions are pressed and sintered together to define the composite.

Preferably, the metal contained by each of said pair of outer portions is the same and conveniently is also the same as the metal contained by the central portion.

Preferably, the outer portion contains some of the same ceramic as the central portion but the ratio of the amount of metal to the amount of ceramic in each of the outer portions is greater than in the central portion.

Figure 2:
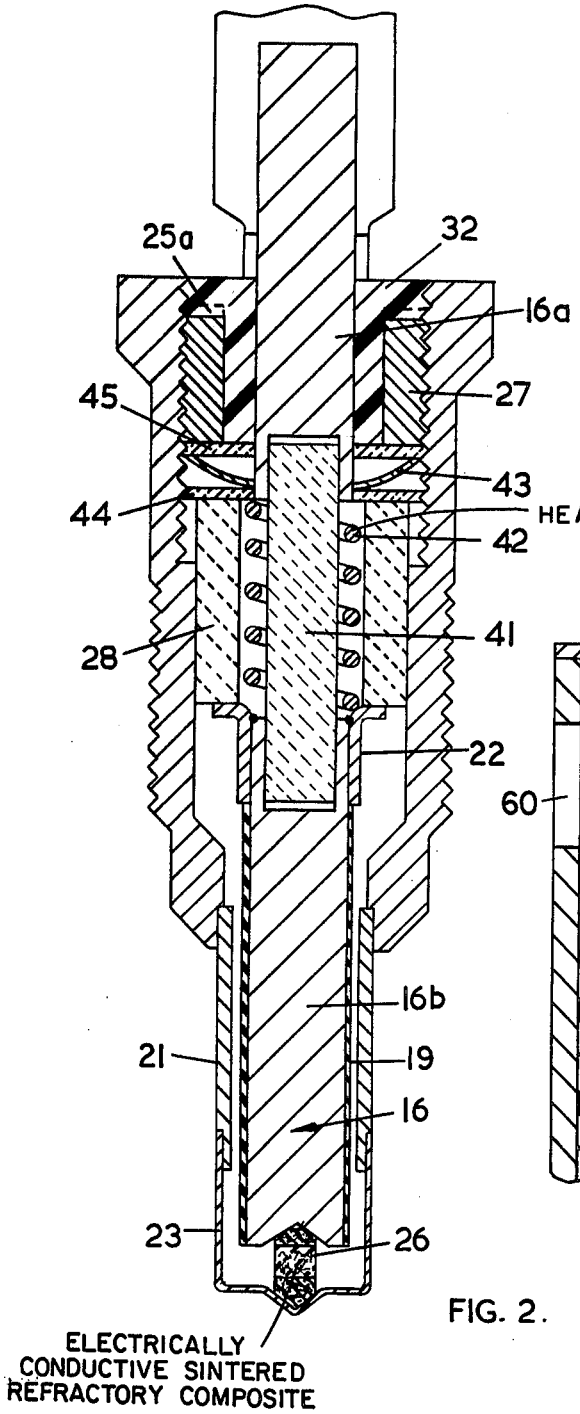
Figure 3:
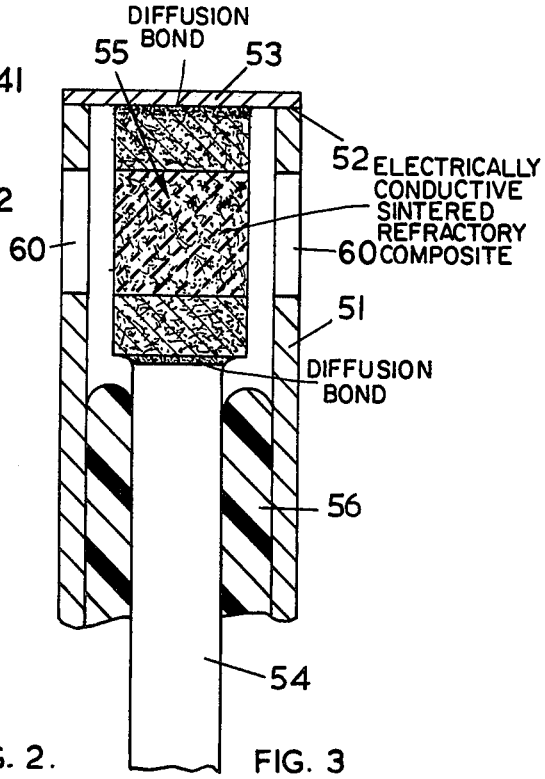

In the accompanying drawings,

FIG. 1 is a sectional view of a starting aid according to a first example of the invention, FIG. 2 is a sectional view of a starting aid according to a second example, and FIG. 3 is a partial sectional view of the part of a starting aid according to a third example.

Referring to FIG. 1, the starting aid of the first "example includes first and second electrodes. The second electrode is, for example, a hollow stepped cylindrical body 11 formed from mild steel and open at its opposite ends". The body 11 is provided with an internal screw thread 14 at its end 12 and is further provided with an external screw thread 15 intermediate its ends. In use, the screw thread 15 serves to mount the starting aid within a complementary screw-threaded bore formed in the wall of the cylinder head of an internal combustion engine.

Extending axially through the body 11 is the first electrode, for example, an electrode rod 16 which is formed from type 310 stainless steel, although may alternatively be formed of mild steel or other stainless steels such as E.N. 61 or E.N. 58. At one end, the rod 16 projects from the end 12 of the body 11 and is provided with an external electrical connector 17, while at the other end a portion 18 of the rod extends from the end 13 of the body 11 and is coated with a layer 19 of enamel. The coated portion 18 is received as a close fit within a sleeve 21 which is formed from type 310 stainless steel and which is secured to the body 11 by way of a copper brazed joint, the enamel layer 19 serving to insulate the rod 16 from the sleeve 21. Moreover, the enamel layer 19 is arranged to extend into the body 11 up to a mild steel thrust collar 22 which is brazed to the electrode rod 16, whereby the layer 19 also insulates the rod 16 from the end 13 of the body 11.

It is to be appreciated that as an alternative to the arrangement shown, the portion 18 of the rod 16 could be of substantially small diameter than the sleeve 21. In this case, the insulating, enamel layer 19 would be replaced by a ceramic tube or an insulating cloth, the latter conveniently being formed of refrasil, a trade name for woven glass or quarty fiber and the free end of the portion 18 being headed to retain the insulating medium.

Returning to the example shown in FIG. 1, the free end of the sleeve 21 is resistance welded to the annular rim of a cup-shaped bridgingmember 23 formed from Inconel X750. The arrangement is such that the base 24 of the member 23 is spaced from the free end 25 of the portion 18 of the electrode rod 16 and trapped between the end 25 and the base 24 is a cylindrical heating element 26 which will be described in detail below. To locate the heating element 26 in position, recesses are formed in the end 25 and base 24 and the ends of the heating element 26 are shaped so as to be received in the recesses respectively, although in this example the heating element is not actually joined to the member 23 and rod 16. It is, however, to be appreciated that other ways of locating the heating element 26 can be employed, such as by providing recesses in the ends respectively of the heating element and complementary projections on the end 25 and the base 24. Also, the heating element 26 can be joined to the end 25 of the rod 16 and/or the base 24 of the member 23. Suitable methods of effecting such joints are by brazing and diffusion bonding, both of which techniques will be described below.

Engaged with the internal screw thread 14 is an annular mild steel, externally screw threaded stud 27 which traps an alumina tube 28 against the collar 22 by way of a steel or aluminium sealing washer 29. Conveniently, a further annular washer 31 formed frm asbestos or Fiberfrax is interposed between the washer 29 and the tube 28, with stud 27, the tube 28, the washer 29 and, where applicable, the washer 31 all extending around, but being spaced from, the electrode rod 16. Moreover, the stud 27 is provided with a slot **27*a* adapted to receive a screwdriver and is screwed into the portion 14 so that the tube 28 is forced against the thrust collar 22, which is of course secured to the electrode rod 16. Thus, the electrode rod 16 is urged towards the contact member 23 so that the heating element 26 is compressed between, and is urged into physical and electrical contact with, the electrode rod 16 and the contact member 23. In one practical embodiment, the electrode rod 16 is urged by the stud 27 to apply a compressive load of between 7.5 and 300 $MN/m^2$ to the heating element 26. When the stud 27 has been screwed into the body 11 by the required amount, the space between the electrode rod 16 and the stud 27, washer 29 and tube 28 is filled with an epoxy resin sealing compound 32. The compound 32 of course insulates the electrode rod 16 from the stud 27 and washer 29, and also prevents the escape of combustion gases through the end 12** of the body.

The heating element 26 is in the form of a sintered, electrically conducting, composite, refractory block and consists of a pair of end portions 33,34 and a central portion 35. The end portions 33, 34 define the electrical contacts of the heating element and are composed of sintered chromium powder mixed with some chromium oxide powder to prevent lamination. The central portion 35 defines the high resistance part of the heating element and is composed of sintered chromium oxide mixed with some chromium powder to render the portion 35 conductive.

The heating element 26 is produced by first wet ball milling chromium metal powder as supplied by Koch-Light Laboratories Limited as type 8941H for 2½ hours so as to reduce the mean Fisher particle size of the powder to between one and nine microns. The powder is then dried and sieved and is made into an aqueous slurry with chromic oxide powder which is supplied by Hopkins & Williams Limited as type 315400 and which has previously been dried and sieved and has a mean Fisher particle size of 0.7 microns. The slurry is arranged to contain 50% by volume of the chromium powder and 50% by volume of the chromium oxide powder, and is blended in a Z-Blade mixer together with 2% by weight of a binder in the form of Celacol M450 as supplied by British Celanese Limited. The mixer is fitted with a heating jacket so that, after mixing, the slurry is dried to form an intimately mixed powder, which is then passed firstly through a 500 micron sieve and then through a 250 micron sieve. The portion of the mixture retained by the latter sieve is retrieved and is heated in an oven to ensure that the powder is completely dry and free flowing. The powder mixture is to define the end portion 33, 34 of the heating element. The same procedure is repeated to produce the powder mixture required for the central portion 35, but in this case the slurry is arranged to contain 24% by volume of the chromium powder and 76% by volume of the chromic oxide powder.

Both sets of powder mixture are then lubricated by dry roll mixing with 0.5% by weight of magnesium stearate, whereafter 0.03gm of the high chromium content mixture is introduced into a cylindrical die cavity of 3mm diameter in a hardened steel, floating die. The die is arranged so that the axis of the die cavity is vertical and the sample of the high chromium content mixture is poured onto a first punch located 3mm from the top of the die. The arrangement is such that the powder mixture then fills the space above the first punch and, after removal of any surplus powder, the first punch is lowered by a distance of 7.5mm. A 0.06gm sample of the high chromium oxide content mixture is then introduced into the die cavity to fill the space above the powder already present, whereafter any surplus powder is removed and the first punch is lowered by a further 3mm. A further 0.03gm sample of the high chromium content mixture is then introduced into the die cavity and the resultant three layer mixture is pressed between the first punch and a second punch at an applied load of 550 $MN/m^2$. Each punch is recessed at its surface presented to the powder mixture so that the green compact produced by the pressing operation has the projections required for location of the final heating element 26 in the starting aid. In one particular example the recess in each punch is of conical form with the included angle of the cone being 140°.

After removal from the die cavity the green compact is heated in a dry, oxygen-free argon atmosphere at a rate 300° C per hour until a temperature of 1400° C is reached. The compact is held at this temperature for one hour and is then allowed to cool, the complete heating and cooling cycle taking 11 hours. The resultant sintered block is 94% of theoretical density and has resistance of between 0.11 and 0.19 ohm. However, by varying the amount of powder mixtures used to produce the green compact, it is possible to obtain sintered blocks having resistances between 0.1 and 0.7 ohm. Finally, the block is machined by a centreless grinding operation so as to produce the required heating element 26 having a diameter of 2mm and a resistance of between 0.12 and 0.20 ohm. Again, however, variation in the composition of the green compact enables different resistance values to be obtained, so that by employing the technique described above it is possible to produce heating elements having resistances between 0.1 and 1.2 ohm.

It is to be appreciated that the technique described above for the production of the heating element 26 can be modified in various ways, such as by altering the amount of chromic oxide powder in the end portions 33, 34. Thus, in one such modification, the end portions 33, 34 are produced from a mixture containing 80% by volume of chromium powder and 20% by volume of chromic oxide powder, the mixture being produced in the manner described above. It is, however, possible to dispense with the chromic oxide in the end portions 33, 34, or to replace the chromic oxide with another metal oxide ceramic, such as alumina. For example, a satisfactory heating element can be produced in which the powder mixture used to define the end portions 33, 34 consists of 90% by volume of chromium powder and 10% by volume of alumina powder, the chromium powder being that employed above but being milled for 24 hours so as to have a particle size between 0.65 and 1.5 microns and the alumina powder being the fine grain material supplied by Degussa Limited with a particle size of 0.03 microns. Moreover, satisfactory results are also obtained when the end portions 33, 34 consist solely of the chromium powder employed in the above example.

In a further modified form of the heating element 26, the end portions 33, 34 are omitted so that the heating element consists entirely of the high chromic oxide content mixture used to produce the portion 35 in the above example. Production of the high chromic oxide content mixture can then proceed as previously, although satisfactory results have also been obtained when the chromium powder employed has been milled for 48 hours so as to reduce its particle size to 0.5 microns. It is, however, found to be desirable in this further modification to perform the sintering operation in the presence of a chromium-rich atmosphere so as to minimise loss of chromium from the mixture during sintering.

In addition, the composition of the mixture used to produce the portion 35 of the heating element 26 can be modified provided the resistivity of the mixture after sintering is between 10 and 0.01 ohm cm at room temperature. To obtain resistivity values within the required range for mixtures consisting of chromium and chromic oxide powders, it is preferable to ensure that the chromium content is between 23% and 25% by volume, although successful results can also be obtained with mixtures containing between 19% and 35% by volume of chromium. Thus, in one such modification the mixture contains 23% by volume of chromium powder and 77% by volume of chromic oxide powder, the composition of the remainder of the heating element and the method of producing the element otherwise being the same as in the above example. With this arrangment it is possible to produce a sintered block having a resistance of between 0.2 and 1.2 ohms and a final heating element of between 0.4 and 2.0 ohms. In yet a further modification, the chromic oxide powder in the mixture used to define the central portion 35 in the above example is replaced by alumina powder and moreover the resultant powder is used to define the entire heating element so that the end portions 33, 34 are dispensed with. Again, it is found to be desirable to perform the sintering operation in a chromium-rich atmosphere to minimise the loss of chromium metal at the sintering temperature.

In the starting aid described above, it may in some cases be desirable to connect the heating element 26 in series with a resistance element (not shown) having a high positive temperature co-efficient of resistance (PTC) as compared with that of the heating element. The resistance element would be provided externally to the body 11 and would mean that, in use, when the electrode rod 16 was connected to the source of electrical supply, the heating element 26 would initially be rapidly heated owing to the fact that the PTC resistance element, being cold, would have a low resistance so that a high current would flow through the heating element. However, the resistance element would rapidly start to heat up with the result that its resistance would increase, thereby reducing the magnitude of the current flowing through the heating element. Thus, the provision of the resistance element would serve to prevent overheating of the heating element 26.

As an alternative to the arrangement described above, the heating element 26 could be placed under compression by urging the sleeve 21 and the body 11 against each other as they are brazed together, the electrode rod 16 and stud 27 being kept stationary. With such an alternative, a fused glass seal is conveniently formed between the enamel layer 19 and the body 11, prior to the brazing operation, so as to prevent ingress of combustion gases into the body 11 from the end 13 thereof when the starting aid is in use in a combustion engine.

In a modification of the starting aid described above, the heating element 26 is joined to the bridging member 23 and/or the end portion 18 of the electrode rod 16 by brazing. A suitable brazing alloy is that sold as Nicrobraz 30 which consists of nickel together with 19% by weight of chromium and 10% by weight of silicon and using the alloy brazing is effected at 1200° C in a vacuum of $10^{-4}$ torr. Nicrobraz LM is another suitable alloy which consists of nickel together with 6.5% by weight of chromium, 3% by weight of boron, 4.5% by weight of silicon, 2.5% by weight of iron and up to 0.006% by weight of carbon, this alloy being employed at a temperature of 1050° C and again at a vacuum of $10^{-4}$torr. Yet another suitable alloy is Nicrobraz 150 which consists of nickel together with 3% by weight of boron, 4.5% by weight of silicon and up to 0.06% by weight of carbon and which is also used at 1050° C and a vacuum of $10^{-4}$torr. It is to be appreciated that each of the alloys discussed above melt about 1000° C which is necessary because the heating element of the starting aid is intended to operate at a temperature of 900° C. Moreover, each of the alloys is arranged to contain at least 2% silicon, since it is found that the alloy does not wet the heating element if the silicon content falls below this value.

In a further modification of the starting aid described above, the heating element 26 is joined to the end 25 of the electrode rod 16 and to the bridging member 23 by diffusion bonding. This is effected by locating the components in a vacuum chamber and pressing the end 25 and bridging member 23 into physical and electrical contact with the end portions respectively of the heating element 26. The vacuum chamber is then evacuated and current from a D.C. source is passed between the electrode rod 16 and the member 23 through the heating element to heat the assembly. The arrangement is such that the temperature of the assembly is thereby raised to a value such that diffusion of metal occurs between the rod 16, the element 26 and the member 23, whereby the member 23 and rod 16 become diffusion bonded to the element 26. In one practical embodiment, satisfactory joints were obtained when a current of 10 amps was passed between the electrode rod 16 and member 23 for 8 minutes, the vacuum chamber being evacuated to $10^{-4}$ torr. It is to be appreciated that the diffusion bonding technique described above can only be employed with heating elements having a metal-rich end portions.

Referring now to FIG. 2, it will be seen that the starting aid of the second example is similar to that described above. Thus, where components of the second example correspond with parts of the starting aid of the first example, these components are identified by the same reference numerals as are employed in FIG. 1. It will, however, be noted that the electrode rod 16 in the second example is formed in two parts 16*a*, 16*b* which are movable relative to each other; and trapped between the parts so as to be located within the tube 28 is an alumina rod 41. Wound around the rod 41 is a helical resistance element 42 which at its end is resistance welded to the parts 16*a*, 16*b* respectively of the electrode rod and resilient to permit slight relative movement between 16*a* and 16*b*. As in the previous example, the resistance element 42 is arranged to have a high positive temperature co-efficient of resistance (PTC) as compared with that of the heating element 26 so that, in use, the resistance element 42 serves to prevent overheating of the element 26.

In the second example, the heating element 26 is again compressed between the electrode rod 16 and a cup-shaped bridging member 23, although compression is now provided by a Belle-Ville washer 43 trapped between the tube 28 and a screw-threaded stud 27. Annular washers 44,45 formed from asbestos or Fiberfrax are interposed between the washer 43 and the tube 28 and a screw-threaded stud 27 respectively, and as in the previous example the space between the electrode rod 16 and the stud 27 is filled with epoxy resin sealing compound 32. It is, however, now necessary to ensure that the sealing compound 32 does not come into contact with the washer 43 since this would of course interfere with the operation of the washer. Thus, the washer 45 is arranged to be a tight fit on the rod 16 and the screw threads on the stud 27 are coated with Loctite.

Referring to FIG. 3, the starting aid of the third example includes a hollow, cylindrical, stainless steel body 51 which is closed at one end 52 thereof by a stainless steel end cap 53. Extending axially within the body 51, but spaced therefrom, is an electrode pin 54 which at its free end is bonded to one end of a cylindrical heating element 55, the other end of which is bonded to the cap 53. The starting aid would have a construction similar to FIG. 1, with electrode pin 54 corresponding to electrode rod 16 and body 51 corresponding to sleeve 21. The heating element 55 is therefore electrically connected to the electrode pin 54 and body 51 so that, when the starting aid is in use in a combustion engine, electric current can be passed between the pin 54 and body 51 to cause the element 55 to heat up and so initiate combustion of fuel supplied to the engine. A fused glass insulation 56 fills the annular space defined between the body 51 and the electrode pin 54, but terminates short of the element 53. The insulation 56 serves to retain the pin 54 in its required position in the body 51 and also to prevent escape, in use, of combustion gases through the bore in the body 51. In addition, it may in some cases by desirable to provide the body 51 adjacent at the end 52 thereof with one or more apertures 60 to improve the heating effect of the element 55.

The element 55 has the same composition as the element 26 of the previous example and is connected to the pin 54 and cap 53, without being under compression, by diffusion bonding. Moreover, the cap 53 is secured to the body 51 by electron beam welding. As in the previous example, the heating element 55 is conveniently protected from over-heating, in use, by a resistance element (not shown) having a high positive temperature co-efficient of resistance compared with that of the heating element.

In a fourth example (not shown) the starting aid is similar to that of the previous example, but the end cap is now omitted and an annular heating element is secured between the body of the starting aid and the electrode pin. The heating element is again in the form of an electrically conducting, refractory block and is formed by sintering a mixture of chromium and chromic oxide powders which are conveniently the powders used in the first example.

In producing the heating element, the chromium powder is first ball milled in water with steel balls to a Fisher Sub Sieve Size of 0.5 microns, the chromic oxide powder as supplied having a Fisher Sub Sieve Size of 1.7 microns. 22% of the chromium powder and 78% of the chromic oxide powder are then dry mixed to produce an intimately mixed powder having a solid content of 60% by weight of a binder. The mixture is then transferred to a steel die and is cold pressed at $13.8 MN/m^2$ into a self supporting compact, which is then heated in an argon atmosphere at a rate of 100° C per hour until a sintering temperature of 1400° C is reached. The compact is retained at this temperature for a further hour and, owing to the high rate of pressure of chromium metal, the sintering is carried out in a furnace provided with a quantity of chromium metal powder close to the compact to maintain a chromium-rich atmosphere around the compact, thereby minimising chromium metal loss from the compact. The final sintered body has a resistivity value of 0.065 ohm cm at room temperature.

It is to be appreciated that other powder mixtures can be employed to produce the heating element of the fourth example provided after sintering the mixtures have a resistivity value at room temperature within the range 10 to 0.05 ohm cm. To obtain resistivity values within this range for mixtures consisting of chromium and chromic oxide, it is preferable to ensure that the chromium content is between 20.5 and 22.5% by volume, although successful results can also be obtained with mixtures containing between 19% and 25% by volume of chromium.

The heating element of the fourth example is secured between the electrode pin and the body of the starting aid either by high temperature brazing, welding, or by shrink sitting. It is of course necessary in each case to ensure that a good physical and electrical connection between the heating element, the body and the electrode pin is produced. As before, the starting aid of the fourth example is conveniently provided with a resistance element having a high temperature co-efficient of resistance as compared with that of the heating element so as to protect the heating element against overheating in use.

We claim:

1. In an ignition aid for internal combustion engines comprising a first metallic electrode, a second metallic electrode and a resistive heating means in circuit with and responsive to electric current passing through the first and second electrodes, for igniting a combustive mixture in said engine, the improvement wherein:

said second electrode comprises an electrically conductive hollow body, removably insertable in an aperture in said engine, said body including a sleeve member and an electrically conductive bridge portion bridging one end of said sleeve member;

said heating means comprising a sintered, refractory, ceramic composite having a central portion interposed between a pair of terminal-defining end portions, said central portion having a higher electrical resistance than said end portions;

said first electrode extending into the sleeve member of said body but being spaced therefrom, said first electrode comprising two parts which are relatively movable, said heating means disposed between one part of said first electrode and said bridge portion with said terminal end portions in a non-point contact relationship with said first electrode and said bridge portion;

spring means associated with said relatively movable parts of said first electrode for establishing electrical contact between said one part of first electrode and the bridge portion of said second electrode and said end portions of said heating means;

means for electrically connecting said relatively movable parts of said first electrode while permitting relative movement between said parts; and sealing means for blocking said space between the other part of said first electrode and said sleeve member of said body, preventing the passage of combustion gases therebetween, insulating and fixably positioning the other part of said first electrode with respect to said second electrode.

2. The apparatus of claim 1, wherein said sealing means is an epoxy resin.

3. The apparatus of claim 1, wherein said ceramic composite comprises a metal oxide.

4. The apparatus of claim 1, wherein said means for electrically connecting includes a positive temperature coefficient resistance element electrically connecting said relatively movable parts of said first electrode.

5. In an ignition aid for internal combustion engines comprising a first metallic electrode, a second metallic electrode, and resistive heating means in circuit with and responsive to electric current passing through said first and second electrodes, for igniting a combustion mixture is said engine, the improvement wherein:

said second electrode comprises an electrically conductive hollow body, removably insertable in an aperture in said engine, said body including a sleeve member and an electrically conductive bridge portion bridging one end of said sleeve member;

said heating means comprising a sintered, refractory, ceramic composite having a central portion interposed between a pair of terminal defining end portions, said central portion having a higher electrical resistance than said end portions;

said first electrode extending into the sleeve member of said body but being spaced therefrom, said heating means disposed between said first electrode and said bridge portion with said terminal end portions in a non-point contact relationship with said first electrode and said bridge portion;

means for establishing electrical contact between said first electrode and the bridge portion of said second electrode and said end portions of said heating means, comprising a diffusion bond between said first electrode and one of said end portions, and between said bridge portion and the other of said end portions; and sealing means for blocking said space between said first electrode and said sleeve member of said body, preventing passage of combustion gases therebetween, insulating and fixably positioning said first electrode with respect to said second electrode.

6. The apparatus of claim 5, wherein said sleeve member comprises means defining apertures in said sleeve member for increasing access of said combustion fixture to said heating means.

7. The apparatus of claim 5, wherein said sealing means is a fused glass.

* * * * *